United States Patent [19]

Hermanson

[11] 4,215,711

[45] Aug. 5, 1980

[54] DISPOSABLE UMBRELLA OF PAPERBOARD MATERIAL OR THE LIKE

[76] Inventor: Terry Hermanson, c/o Mr. Christmas Inc., 41 Madison Ave., New York, N.Y. 10010

[21] Appl. No.: 973,841

[22] Filed: Dec. 28, 1978

[51] Int. Cl.[2] ..... A45B 13/00; A45B 19/00

[52] U.S. Cl. ..... 135/19.5; 135/34

[58] Field of Search ..... 135/19.5, 20, 34

[56] References Cited

U.S. PATENT DOCUMENTS

| | | | |
|---|---|---|---|
| 1,457,679 | 6/1923 | Vincent | 135/19.5 |
| 1,580,864 | 4/1926 | Stevenson | 135/19.5 |
| 1,715,322 | 5/1929 | Foster | 135/19.5 |
| 1,783,972 | 12/1930 | Moses | 135/19.5 X |
| 2,455,288 | 11/1948 | Alvarez | 135/19.5 |
| 2,667,884 | 2/1954 | Bruno et al. | 135/19.5 X |
| 2,757,679 | 8/1956 | Rivkin et al. | 135/19.5 X |
| 2,767,722 | 10/1956 | Smith | 135/19.5 |
| 4,062,369 | 12/1977 | Hermanson | 135/19.5 |
| 4,114,634 | 9/1978 | Hermanson | 135/19.5 |

*Primary Examiner*—J. Karl Bell

*Attorney, Agent, or Firm*—Karl W. Flocks

[57] ABSTRACT

A disposable umbrella comprising a foldable canopy of paperboard material or the like in combination with first and second foldable support members of paperboard material or the like, the first and second support members each including a pair of wing-like struts with downwardly extending tail portions, upwardly directed edges supporting the canopy, and a connector element foldably connecting the pair of struts, the connector element having a generally vertically extending axis in the opened condition of the umbrella.

10 Claims, 11 Drawing Figures

DISPOSABLE UMBRELLA OF PAPERBOARD MATERIAL OR THE LIKE

BACKGROUND OF THE INVENTION

1. Field of the Invention

The present invention relates to an umbrella, which as in the ordinary course of events, may become useful in case of rain or like precipitous climatic conditions. More particularly the present invention relates to a low cost disposable umbrella, the construction of which is believed would most likely be found with art classified in Class 135, Subclasses 19.5, 20R, and 34 in the United States Patent Office if such construction were to actually exist in the prior art.

2. Description of the Prior Art

The most relevant prior art known to applicant insofar as the present invention is concerned includes the following U.S. Pat. Nos.

1,457,679—VINCENT
1,580,864—STEVENSON
1,715,322—FOSTER
2,455,288—ALVAREZ
2,757,679—RIVKIN et al
2,767,722—SMITH
4,062,369—HERMANSON

Of the art listed above, FOSTER, U.S. Pat. No. 1,715,322 is of interest in that it discloses an umbrella comprising the broad combination of a canopy of cardboard or like material with a pair of handle or support members of cardboard material foldably secured to the underside thereof.

STEVENSON, U.S. Pat. No. 1,580,864, is of interest in that it discloses an umbrella having a canopy secured to a plurality of radially extending ribs 12 which may be of cardboard and have handle portion 16. The ribs 12 and handle portions 16 are stacked upon each other when the umbrella is closed.

SMITH, U.S. Pat. No. 2,767,722, is of interest in that it discloses an umbrella of the type disclosed in Foster, but developed to the extent of including foldable support flaps 17 and 18 which are secured together and formed with hand receiving apertures and foldable support flaps 19 and 20 also secured to each other. As may be understood from FIGS. 3 and 4 of Smith in the umbrella disclosed therein, flaps 17 and 18 and flaps 19 and 20 extend generally along a single diametrical plane when the canopy is erected.

The VINCENT U.S. Pat. No. 1,457,679 is of interest in that it relates to a foldable umbrella comprising a canopy and support ribs of cardboard or like material wherein the portions of the canopy are foldable between folds of the ribs, as may be seen in FIG. 5. The Vincent umbrella also includes a rod 11 and disk 12 slidably extending therearound and in cooperation therewith to reinforce the ribs as illustrated in FIG. 6.

The ALVAREZ U.S. Pat. No. 2,455,288 is of interest in that it discloses the use of a pair of bendable supporting ribs each of which includes a pair of portions extending extending generally at right angles to each other when the umbrella is erected. The canopy of the umbrella in the Alvarez patent comprises a generally rectangular web and may be rolled around the various components into storage condition.

The RIVKIN et al U.S. Pat. No. 2,757,769 is of interest in that it shows umbrellas with various forms of foldable canopies. The umbrella construction illustrated in FIGS. 8–12 of Rivkin et al is of particular interest in that in addition to including a foldable canopy of cardboard material, it includes two foldable cardboard support members of which one member has a hand grip.

The HERMANSON U.S. Pat. No. 4,062,369 is of interest in that it discloses a disposable umbrella with a canopy which is generally similar to that which is disclosed in the present application.

While the prior art patents noted above all relate to umbrellas, some of which include features generally similar to those included in the umbrella disclosed herein, they do no disclose nor do they suggest the canopy and specific support structure in combination therewith to provide the umbrella disclosed herein.

SUMMARY OF THE INVENTION

The present invention as disclosed herein relates to a new and improved umbrella, which because of its low cost material and its ease of manufacture, is expendable and disposable.

An important advantage of the present invention relates to the facility with which the disclosed disposable umbrella may be assembled into a compact condition for merchandising in coin operated machines, for example.

Another advantage of the present invention is the ease with which one may open the disclosed umbrella and convert it to operational condition.

Still another advantage of the disclosed invention resides in the simplicity of parts required in its assembly.

Yet another advantage of the present invention resides in the effectiveness of the locking means by which the disclosed invention may be maintained in opened condition.

DETAILED DESCRIPTION OF THE INVENTION

Figure 1:
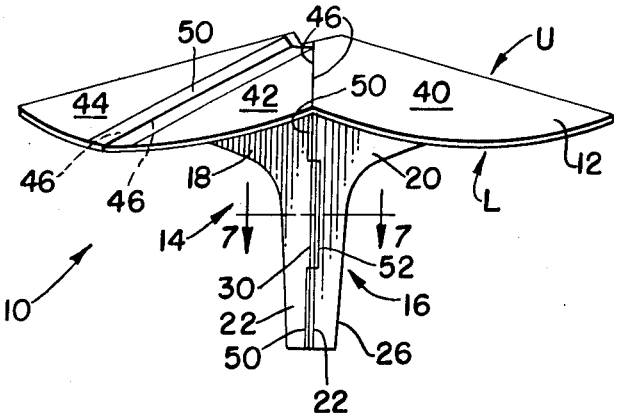
FIG. 1 shows an elevational view of the umbrella according to the present invention in opened condition for use.

Referring particularly to the drawings, the reader will readily visualize in FIGS. 1–4 the umbrella 10 opened for use according to the invention disclosed herein. Umbrella 10 comprises three principal parts namely a foldable canopy 12, and first and second foldable support members 14 and 16, respectively. Canopy 12 and both support members 14, 16 are made of paperboard material or the like which is of such stiffness as to be self-sustaining and which will not collapse when opened and erected to protect the user from the elements. Support members 14 and 16 each comprise a pair of wing-like struts 18, 18 and 20, 20, respectively. Each wing-like strut 18 includes a downwardly extending tail portion 2 and an upwardly directed edge 24 supporting canopy 12 in the opened condition of umbrella 10. Similarly, wing-like struts 20, 20 include downwardly extending tail portions 26, 26 and upwardly directed edges 28, 28 which support canopy 12. Struts 18, 18 and struts 20, 20 are foldable about edge portions 30, 32, respectively, which have generally vertically extending axes in the opened condition of umbrella 10 as may be appreciated from FIGS. 1, 5, 6 and 8. Foldable edge portions 30 and 32, which are integral with and foldably connect struts 18, 18 together and struts 20, 20, respectively, are best seen in FIG. 6, although they are also clearly visible in FIG. 8.

Figure 2:
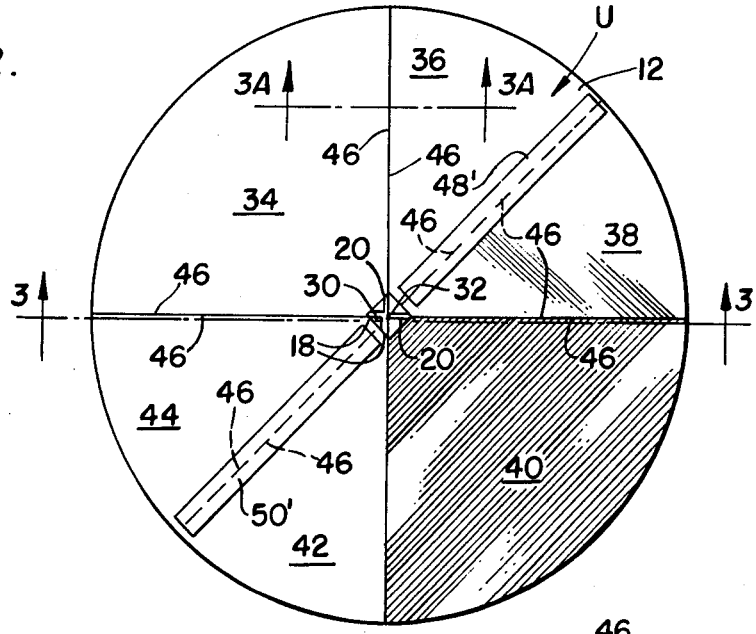
FIG. 2 is a top plan view of the umbrella illustrated in FIG. 1.
Figure 4:
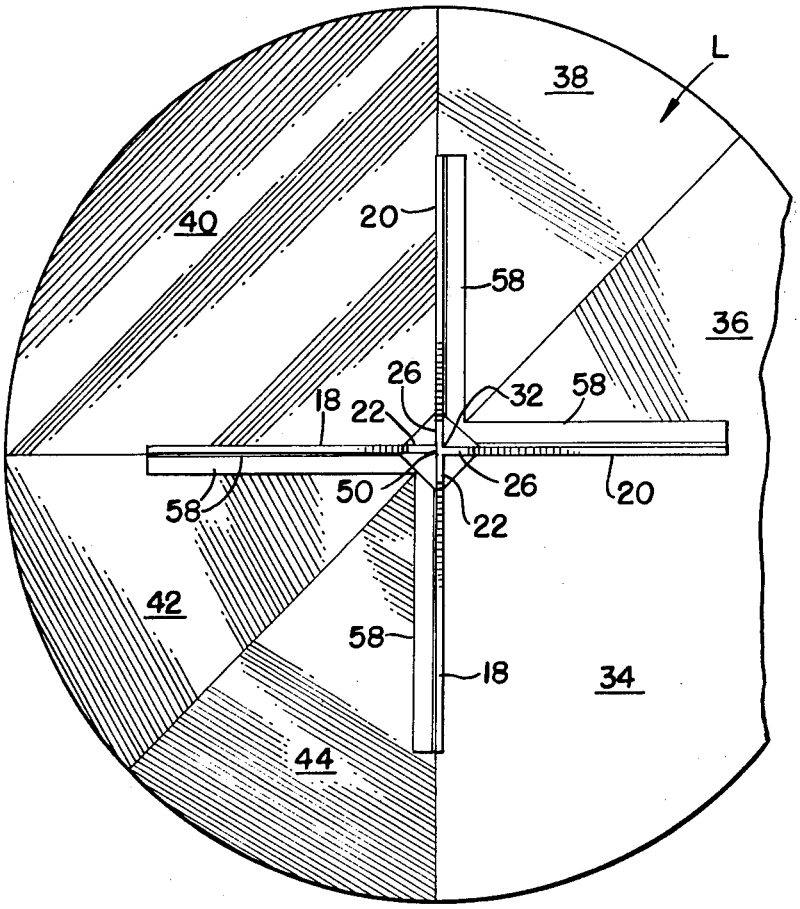
FIG. 4 is a bottom plan view of the umbrella illustrated in FIG. 1 with a portion broken away and omitted.

Canopy 12 can be seen from above in FIG. 2 and from beneath in FIG. 4 to comprise a plurality of generally triangular panels 34, 36, 38, 40, 42, and 44 of which panels 34 and 40 are designated as major panels and panels 36, 38, 42, and 44 are designated as minor panels since the former are larger than the latter. The major panels 34 and 40 are seen to be diametrically opposed to each other in the opened condition of umbrella 10. Each of the panels 34, 36, 38, 40, 42, and 44 has a pair of radial edges 46 extending alongside and foldably connected to the radial edges 46 of two others of the panels 34, 36, 38, 40, 42, and 44. Each major panel 34, 40, as may be readily seen in FIG. 2, is foldably connected to a pair of minor panels 36, 44 and a pair of minor panels 38, 42, respectively, along the adjacent radial edges 46 thereof. It may also be appreciated from FIG. 2 that the minor panels 36, 44 in addition to being foldably connected to major panel 34 are also foldably connected to minor panels 38, 42, respectively, along the adjacent radial edges 46 thereof and that minor panels 38, 42 in addition to being foldably connected to major panel 40 are also foldably connected to minor panels 36, 44, respectively, along the adjacent radial edges 46 thereof.

Figure 3A:
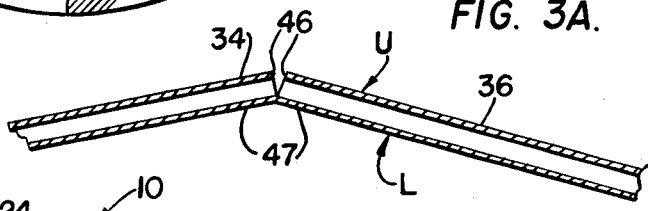
FIG. 3A is an elevational view taken through the plane 3A—3A in FIG. 2.

Each of the panels 34, 36, 38, 40, 42 and 44 in the opened condition of umbrella has a top side and a lower side. From FIG. 3A it is seen that major panel 34 and minor panel 36 are formed integral with each other by lower ply L which constitutes a hinge means 47 along radial edges 46 foldably connecting major panel 34 and minor panel 36. It is also seen in FIG. 3A that major panel 34 and minor panel 36 are separated from each other along radial edges 46 of the upper ply U on the top side of canopy 12. The structural relationships between major panel 34 and minor panel 44, between major panel 40 and minor panel 38, and between major panel 40 and minor panel 42 are to be understood to be similar to the relationship between major panel 34 and minor panel 36 as described above. On the top side of canopy 12 strips of tape 48′ and 50′ are shown in FIG. 2 to be disposed over the upper ply U along radial edges 46 and on opposite sides thereof to effect hinge means foldably connecting minor panel 36 to minor panel 38 and minor panel 42 to minor panel 44, respectively. On the lower ply L of canopy 12, as may seen in FIGS. 4 and 5, the adjacent radial edges 46 of minor panels 36, 38 and of minor panels 42, 44 are not connected or covered by any tape or like element which would restrict movement therebetween.

Bearing in mind that FIG. 4 is an up-side down view of umbrella 10, the reader will readily appreciate that upwardly directed edges 24, 24 of struts 18, 18 extend adjacent to hinge means 47 and substantially coaxially with the radial edges 46 where major panel 34 is connected to minor panel 44 and where major panel 40 is connected to minor panel 42; and that upwardly directed edges 28, 28 of struts 20, 20 extend adjacent to the hinge 47 and substantially coaxially with the radial edges 46 where major panel 34 is connected to minor panel 36 and where major panel 40 is connected to minor panel 38. Support members 14 and 16 are pivotally connected to the lower side of canopy 12 by connector elements 58 in the form of strips of tape, fabric, or the like to permit rotation of struts 18, 18 and 20, 20 substantially about the radial edges 46 or axes of the hinge means 47 connecting major panel 34 to minor panels 36, 44 and major panel 40 to minor panels 38, 42. Although struts 18, 18 and 20, 20 are shown to be connected to minor panels 42, 44 and 36, 38, by connector elements 58, it is to be understood that the same or similar pivotal connection may be effected between struts 18, 18, 20, 20 and major panels 34, 40 instead of minor panels 34, 36, 40, 42.

Figure 6:
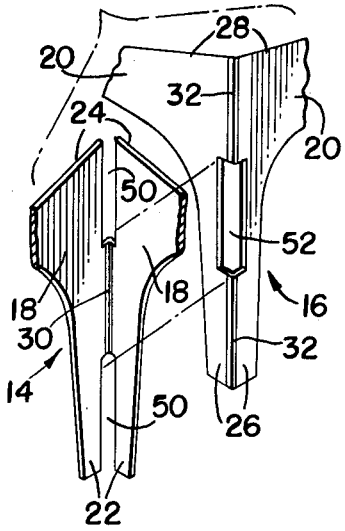
FIG. 6 is an exploded fragmentary view in perspective showing details of portions of support members for the canopy of the disclosed umbrella.
Figure 7:
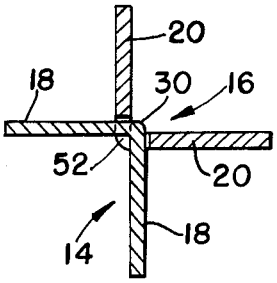
FIG. 7 is a horizontal sectional view taken along the plane 7—7 in FIG. 1 to show the relationship between the support members of FIG. 6 in the assembled and erected condition of the disclosed invention.

Support member 14 in addition to including foldable edge portion 30 which foldably connects struts 18, 18 is formed with elongated cut-outs or notches 50 coaxial with and on opposite ends of foldable edge portion 30 as clearly illustrated in FIG. 6. Support member 16, on the other hand, is seen to be provided with an elongated cut-out or notch 52 extending coaxialy with and between adjacent ends of foldable edge portions 32. The notches 50 and 52 are thus seen to be in series interrupting and alternating with foldable edge portions 30 and 32. In the opened and erected condition of umbrella 10 foldable edge portions 30 and 32 are opened to the extent that struts 18, 18 and 20, 20 extend substantially at 90° to the respective counterpart thereof. Moreover, when umbrella 10 is opened foldable edge portion 30 of support member 14 is co-extensive and in registration with notch 52 of support member 16 as illustrated in FIG. 7, while foldable edge portions 32 of support member 16 are co-extensive with and in registration with notches 50 of support member to provide an interlocking relationship therebetween.

Figure 5:
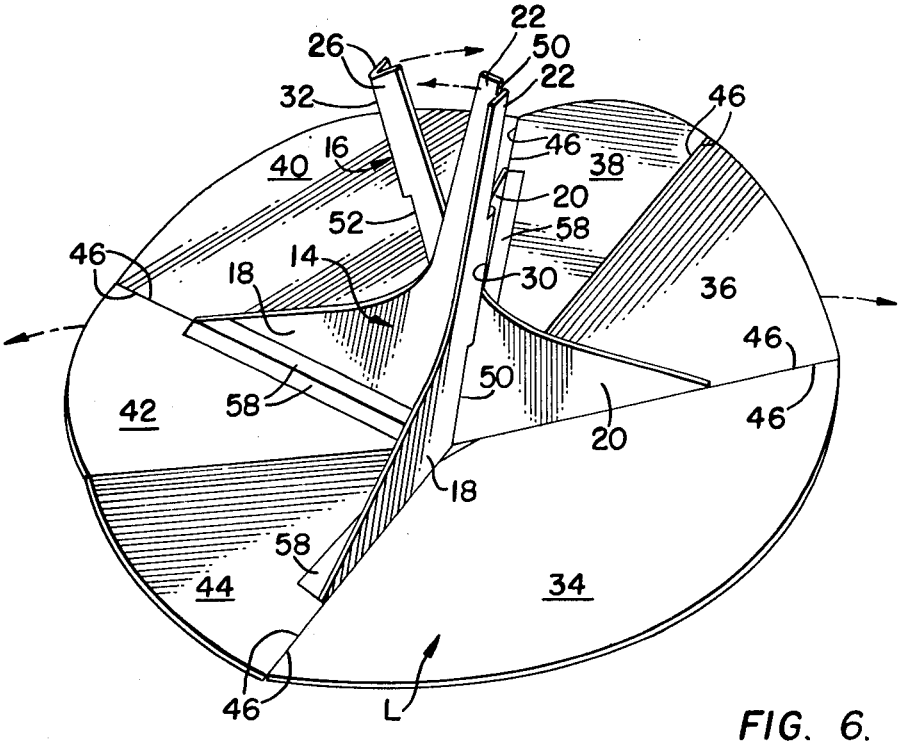
FIG. 5 is a view in perspective of the lower side of the umbrella illustrated in FIG. 1 immediately before the last step is taken to erect it and turn it right side up for use.

As may be appreciated from FIGS. 4 and 5 each pair of struts 18, 18 and 20, 20 subtends an angle opening away from the angle subtended by the other pair and with vertices of such angles being in back-to-back relationship in the opened condition of umbrella 10. The angles subtended by struts 18, 18 and 20, 20 are closed when umbrella 10 is closed as may be appreciated in FIGS. 8 and 10.

Figure 3:
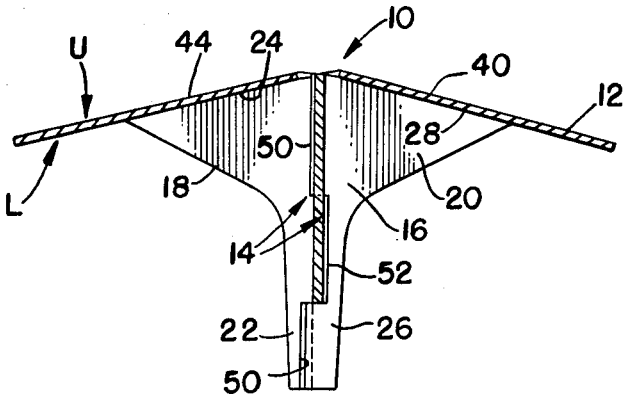
FIG. 3 is an elevational view taken through the plane of 3—3 in FIG. 2.

In FIG. 3 it may be seen that canopy 12 extends downwardly from the center towards its periphery when it is opened and because of this and the downward inclination of upwardly directed edges 24, 28 from the center of canopy 12 toward the periphery thereof, it can be readily understood that the weight or downward forces of umbrella 10 are transmitted through the respective struts 18, 18 and 20, 20 to inherently bias foldable edge portions 30, 32 in registration with the respective notches 52, 50 and to be locked therein.

Downwardly extending tail portions 22, 22 and 26, 26 cooperatively function as a handle for the user in the opened condition of umbrella 10. From FIGS. 1 and 4 it may be readily seen that the lower ends of tail portions 22, 22 and 26, 26 are disposed approximately beneath the center of canopy 12 in the opened condition of umbrella 10.

When umbrella 10 is to be closed foldable edge portions 30 and 32 are pulled in opposite directions to lift them out of registration with notches 52 and 50. The lower side of minor panels 42, 44 and 36, 38 will move between struts 18, 18 and 20, 20, respectively, the struts 18, 18 and 20, 20 being foldable about the edge portions 30 and 32 thereof. When the closing operation of umbrella 10 progresses from that which is illustrated in FIG. 5 to FIG. 8 and FIG. 10, struts 18, 18 of support member 16 will be folded over portions of minor panels 42, 44 and portions of minor panels 36, 38, respectively, and further will be folded between major panels 34, 40 and the lower ends of the tail portions 22, 22 of struts 18, 18 and of the tail portions 26, 26 of struts 20, 20 will pass in opposite directions toward the periphery of canopy 12.

The separation between major panel 34 and minor panel 36 as seen in FIG. 3A and described above is achieved by using multi-ply paperboard material with the top side being subjected to die-cutting along the radial edge 46 between major panel 34 and minor panel 36 through the upper ply U and leaving the lower ply L intact to function as hinge means 47 between the major panel 34 and minor panel 36. Hinge means between major panel 34 and minor panel 44, major panel 40 and minor panel 38, and major panel 40 and minor panel 42 should be understood to be formed in the manner described with respect to major panel 34 and minor panel 36.

Figure 9:
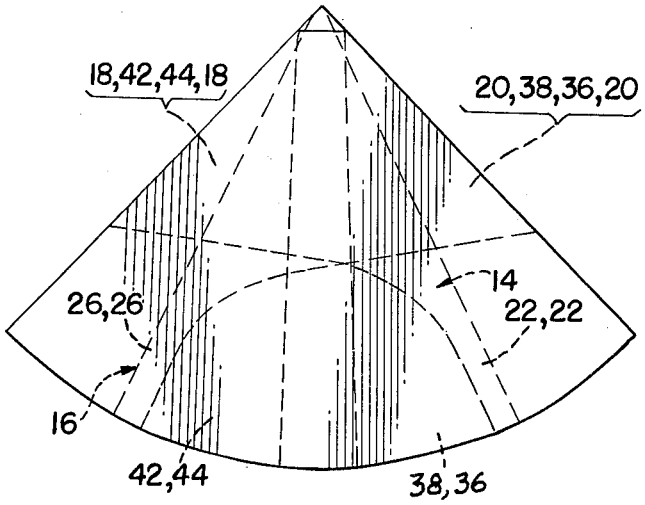
FIG. 9 is an elevational view of the disclosed umbrella when it is closed and leaning against a vertical surface.
Figure 10:
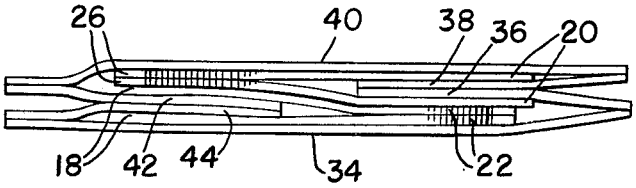
FIG. 10 is a bottom plan view of FIG. 9.
Figure 8:
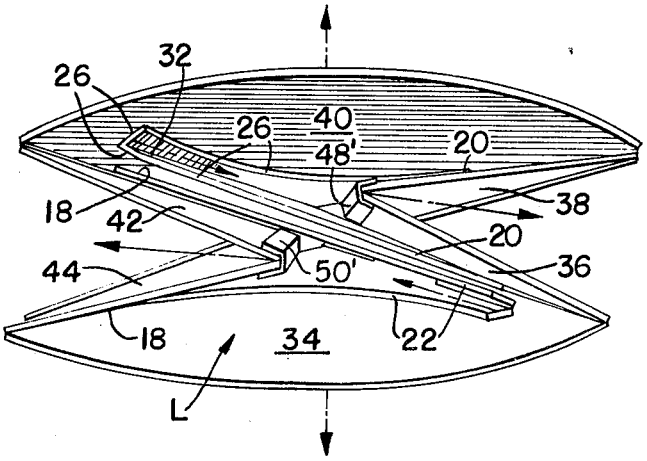
FIG. 8 is a view from the underside of the umbrella according to present invention when it is initially opened to convert it to its erected condition.

When it is desired that umbrella 10 be opened from the folded condition of FIGS. 9 and 10 to put it to use, it is only necessary to spread major panels 34 and 40 apart from each other in the direction of the arrows associated therewith which will automatically and simultaneously move minor panels 36, 38 away from minor panels 42, 44 and tail portions 22, 22 toward tail portions 26, 26 in the directions of arrows associated therewith in FIG. 8. The last step required to open umbrella 10 to put it to use is to urge tail portions 22, 22 just beyond tail portions 26, 26 in the directions indicated in FIG. 5 and then allowing folded edge portions 30, 32 to be snapped into notches 52, 50, respectively, as a result of force transmitted from canopy 12 through struts 18, 18 and 20, 20 to tail portions 22, 22 and 26, 26 as will be understood by reference to FIG. 3.

A closer look at FIG. 8 will show that when umbrella 10 is being closed top side of minor panels 36, 38 will fold toward each other and the top side of minor panels 42, 44 will fold toward each other. Also, when umbrella 10 is being closed the lower sides of major panels 34, 40 will be folded toward each other and toward the respective lower sides of minor panels 36, 44 and 38, 42 connected thereto and folded therebetween.

It will be obvious to those skilled in the art that various changes may be made without departing from the scope of the invention and therefore the invention is not limited to what is shown in the drawings and described in the specification but only as indicated in the appended claims.

What is claimed is:

1. A disposable umbrella comprising a foldable canopy of paperboard material or the like in combination with first and second foldable support members of paperboard material or the like, said first and second support members each having a pair of wing-like struts with downwardly extending tail portions, upwardly directed edges supporting said canopy, and means foldably connecting said pair of struts, said means having a generally vertically extending axis in the opened condition of said umbrella.

2. The disposable umbrella as defined in claim 1 wherein said means comprise one or more foldable edge portions formed integrally with the pair of struts of one of said support members.

3. The disposable umbrella as defined in claim 2 wherein said canopy comprises a plurality of generally triangular panels each of which has a pair of radially extending edges alongside and foldably connected to the radial edges of two others of said generally triangular panels, two of said panels being major panels lying diametrically opposed to each other in the opened condition of said umbrella, the panels connected to said major panels along the radial edges thereof being minor panels which in addition to being foldably connected to one of said major panels are also foldably connected to another one of said minor panels, each of said panels having a top side and a lower side, first hinge means foldably connected each of said major panels along the lower side thereof to the lower sides of the two minor panels connected thereto, second hinge means foldably connecting each of said minor panels along the top side thereof to the top side of the minor panel connected thereto whereby the lower sides of said major panels are foldable toward each other and toward the lower sides of the minor panels connected thereto and the top side of each of said minor panels is foldable toward the top side of the minor panel connected thereto.

4. The disposable umbrella as defined in claim 3 wherein each of said support members as assembled and in the opened condition of said umbrella has the upwardly directed edge of one of its said struts extending adjacent to and substantially coaxially with the axis of the first hinge means connecting one of said major panels to one of said minor panels and the upwardly directed edge of the other of its said struts extending adjacent to and substantially coaxially with the axis of the first hinge means connecting another of said minor panels, which is also connected to the said one of said minor panels, to the other of said major panels.

5. The disposable umbrella as defined in claim 4 wherein the struts of each of said support members are pivotally connected to the lower side of said canopy by connector means for rotation substantially about the axis of the respective hinge means adjacent thereto.

6. The disposable umbrella as defined in claim 5 wherein said support members are formed with notches in a series interrupting and alternating with said foldable edge portions with the foldable edge portions of each of said support members extending in interlocked registration with the notches in the other of said support members in the opened condition of said umbrella.

7. The disposable umbrella as defined in claim 6 wherein the pairs of struts of each of said support members in the opened condition of said umbrella subtend an angle opening away from the angle subtended by the other of said pairs of struts and with the vertices of such angles in back-to-back relationship, said angles being closed by the respective struts subtending them when the umbrella is closed.

8. The umbrella as defined in claim 7 wherein the weight of said canopy on said upwardly directed edges in the opened condition of said umbrella transmits forces to said support members through the respective struts to inherently bias said foldable edges in registration with the respective notches and to be locked therein.

9. The umbrella as defined in any one of said claims 3–8 wherein each of said tail portions has a lower end disposed approximately beneath the center of said canopy in the opened condition of said umbrella, and said struts of each of said support members are foldable over portions of two of said minor panels and between said major panels with the lower ends of the struts of each of said support members passing in opposite directions toward the periphery of said canopy when said umbrella is closed.

10. The umbrella as defined in any one of claims 3–8 wherein said canopy is formed from multi-ply paperboard material, said first hinge means includes a die cut through a first ply on the top side of said canopy but not through to the ply forming the lower side of said umbrella.

* * * * *